US006637975B2

(12) United States Patent
Foxwell

(10) Patent No.: US 6,637,975 B2
(45) Date of Patent: Oct. 28, 2003

(54) WATERCRAFT RAMP

(76) Inventor: Robert D. Foxwell, 6549 Harbor Pl., Prior Lake, MN (US) 55372

( * ) Notice: Subject to any disclaimer, the term of this patent is extended or adjusted under 35 U.S.C. 154(b) by 0 days.

(21) Appl. No.: 10/113,961

(22) Filed: Mar. 29, 2002

(65) Prior Publication Data

US 2002/0141826 A1 Oct. 3, 2002

Related U.S. Application Data

(60) Provisional application No. 60/281,190, filed on Apr. 3, 2001.

(51) Int. Cl.[7] ..... B63C 3/08
(52) U.S. Cl. ..... 405/2; 405/1
(58) Field of Search ..... 405/1, 2, 3, 4, 405/5, 7, 218; 114/344, 263, 230.1

(56) References Cited

U.S. PATENT DOCUMENTS

| | | | | |
|---|---|---|---|---|
| 2,626,072 A | * | 1/1953 | Holsclaw | 414/447 |
| 3,139,277 A | * | 6/1964 | Mears | 269/296 |
| 3,146,599 A | | 9/1964 | Young | |
| 3,221,899 A | | 12/1965 | Gronlund | |
| 3,227,292 A | | 1/1966 | Jacobs | |
| 3,587,874 A | * | 6/1971 | Graf | 414/678 |
| 3,884,430 A | * | 5/1975 | Martin | 242/346.2 |
| 4,507,016 A | | 3/1985 | Honour | |
| 5,184,913 A | | 2/1993 | Meriwether | |
| 5,400,733 A | | 3/1995 | Richter | |
| 5,449,247 A | | 9/1995 | Smith | |
| 5,904,113 A | * | 5/1999 | Slikkers | 114/259 |
| 6,092,961 A | | 7/2000 | Kilgore | |
| 6,182,597 B1 | | 2/2001 | Maxwell et al. | |
| 6,273,016 B1 | * | 8/2001 | Gibbs | 114/230.1 |

FOREIGN PATENT DOCUMENTS

| | | | | |
|---|---|---|---|---|
| FR | 2694251 A1 | * | 2/1994 | B60P/3/10 |
| GB | 2116123 A | * | 9/1983 | B63C/3/00 |

OTHER PUBLICATIONS

Minnesota picture of boat ramp having a single spine.
VE–VE boat ramp sales sheet showing three models.

* cited by examiner

*Primary Examiner*—Heather Shackelford
*Assistant Examiner*—Lisa M. Saldano
(74) *Attorney, Agent, or Firm*—R. C. Baker & Associates, Ltd.

(57) ABSTRACT

The watercraft ramp has a watercraft-supporting assembly with a water end and a shore end. It is formed of a laterally spaced pair of U-shaped rails equipped with hull-supporting roller wheels mounted in the U-shape. A transverse footprint brace is mounted under the rails at the water end and a transverse footprint stabilizer bar is mounted under the rails at the shore end. A winch support beam is mounted to the stabilizer bar so as to upward cantilever out beyond the shore end of the rails in an angular relationship closer to parallel than perpendicular to the rails. The components in unassembled condition can be shipped and then assembled by a customer-user.

31 Claims, 5 Drawing Sheets

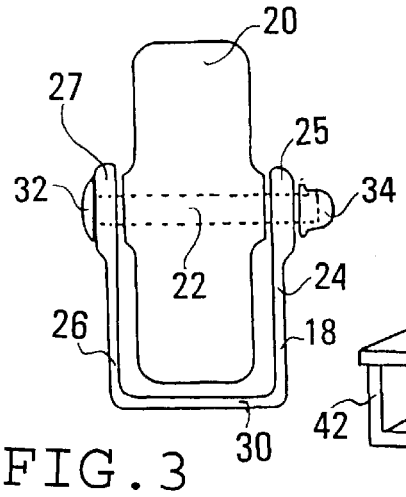
FIG. 3
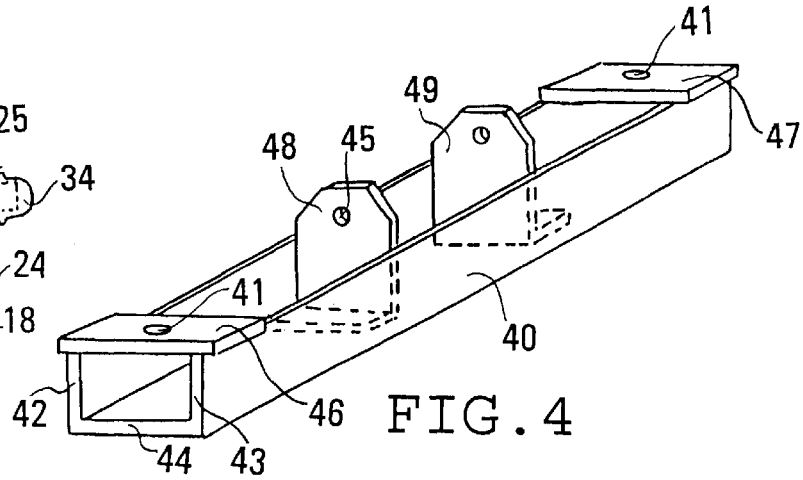
FIG. 4
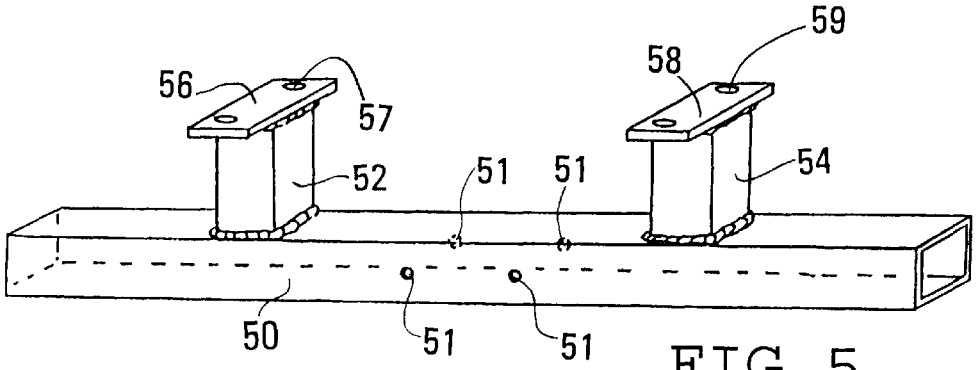
FIG. 5
FIG. 8
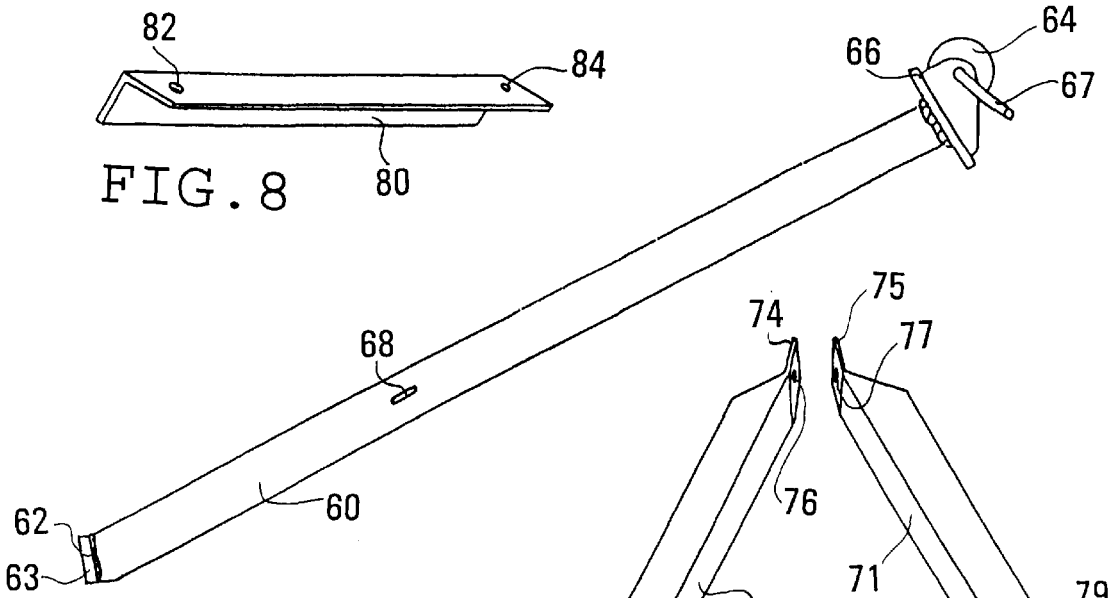
FIG. 6
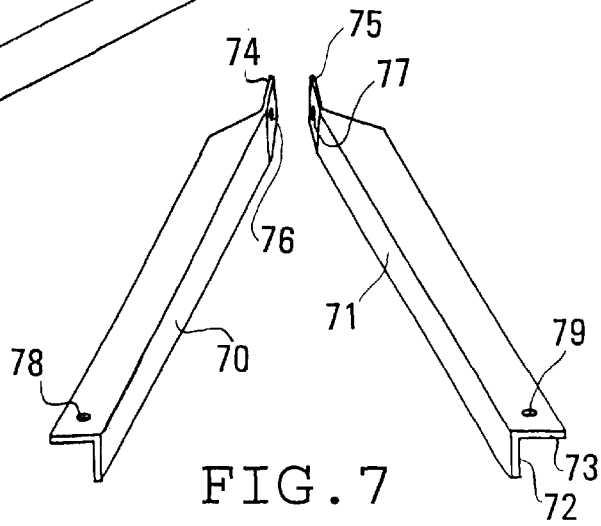
FIG. 7

WATERCRAFT RAMP

CROSS-REFERENCE TO RELATED APPLICATIONS

This application claims the priority benefit of provisional application, Serial No. 60/281,190, filed Apr. 3, 2001.

FIELD OF THE INVENTION

This invention relates to a watercraft ramp and more particularly to a shoreline dock in the nature of a ramp of relatively short length compared to the watercraft capable of being docked on it and of relatively low elevation capable of receiving the bow end of a watercraft while the watercraft is buoyantly floating.

BACKGROUND OF THE INVENTION

Personal watercraft of the type for people to ride in a manner analogous to riding a motorcycle have become exceedingly popular. They not only give the person or persons riding the watercraft the supreme thrill of speed and power, but also can be the workhorse for towing water skiers. The appeal of personal watercraft is so strong that people will ride them on impulse or at the spur of the moment. Between periods of use, however, the personal watercraft should be stored out of the water with as little fuss as possible and launched at will and with great ease for the unlimited fun of using the watercraft.

Heretofore insofar as is known, non-lift ramps for out-of-the water docking and storage of watercraft have suffered from such problems as (i) non-portability caused by a permanent post or concrete anchoring, or (ii) an entry or water end that defies convenient watercraft bow movement onto the ramp while the watercraft itself is still buoyantly supported in the water, or (iii) an entry or water end that requires elevation of the bow with tilting of the watercraft beyond a comfortable buoyancy support in order to initiate movement onto the ramp, or (iv) an entry or water end that always requires a considerable length of ramp to extend out into and under the water in order to facilitate movement of the watercraft onto the ramp using the natural buoyancy of the craft, or (v) a shore or land end that suffers from relatively easy torsional twists or is unnecessarily heavy or is otherwise not user friendly, or (vi) a shore or land end that is considerably longer than actually needed for watercraft support and that fails to utilize a winch mounting in a way to reduce such length.

In short, the problem with known docking ramps is that they lack simple and uncomplicated and lazy or minimal-physical-effort features for fast and effective personal watercraft use, including easy portability and easy docking, storage, and launching at will.

SUMMARY OF THE INVENTION

The new watercraft docking and launching ramp of this invention is astonishingly simple and strong and yet easily portable. It has an extremely low profile compared to known ramps. The water end of the ramp is designed to rest in earth supported condition on the water side of a shoreline, and the shore end or opposite end of the ramp is designed to rest on dry land of a shore up from the shore line.

The watercraft-supporting assembly of the ramp comprises a pair of rails braced in parallel spaced relationship and equipped with hull-supporting roller wheels. Ideally, the rails are U-shaped and have upstanding side walls on each side of a floor; and the roller wheels are mounted within the U-shape and extend above it. The ramp (and in particular the rails of it) is generally of relatively short length in comparison to the length of watercraft capable of being docked or received on it.

At the water end is a support assembly for the rails that causes minimal elevation for the water end. This support assembly has a transverse footprint brace extending between the rails at a location proximate to the water end so as to support the rails and maintain their spaced relationship at the water end. A keel roller may be mounted at a central location on the footprint brace.

The shore end support assembly also is such as to cause minimal elevation for the shore end of the ramp. This assembly has a transverse footprint stabilizer bar of a transverse length greater than the distance between the rails of the watercraft-supporting assembly. The rails at the shore end can be and desirably are mounted to the footprint stabilizer bar through stub elevational means such as stub pillars or stub blocks so as to obviate irregular or rocky shore problems.

A loading assembly has a winch support beam that is mounted to the stabilizer bar in such a way as to upwardly cantilever in an outward direction from (i.e., beyond) the shore end of the rails at an angle that is more toward being parallel to the rails than perpendicular to the rails. Ideally, the winch support beam is braced against lateral or torsional movement by a pair of brace arms mounted in opposing relationship to the winch support beam and then fanning out therefrom as they extend over the stabilizer bar to lateral mounting locations on the watercraft-supporting assembly.

Many details of the aforenoted features contribute to the overall strength and lightness in weight and portability of the ramp. To be especially noted, however, is that, while the several assemblies as afore-recited may be permanently mounted together, by far the preferred approach is to employ removable mounting as by bolting the several parts of the ramp together. A significant advantage of the new teaching is that the components or parts forming the ramp assemblies of the invention can be conveniently packaged, economically handled, and economically and quickly shipped to any destination for final assembly and use.

Still other benefits and advantages for the various features of the invention will be evident as this description proceeds.

DESCRIPTION OF THE DRAWINGS

FIG. 3 is a schematic cross-section taken on line 3—3 of FIG. 1 and particularly illustrates the U-shape for the rail and the mounting of the roller wheels;

FIG. 4 is a schematic view, partially broken away, of the footprint brace at the water end for the ramp (with the keel roller omitted);

FIG. 5 is a schematic perspective view of the transverse footprint stabilizer bar with its stub blocks topped with mounting plates for bolted mounting to the shore end of the rails;

FIG. 6 is a side view of a winch-supporting beam for the ramp;

FIG. 7 is a schematic perspective view of brace arms for the winch-supporting beam;

FIG. 8 is a schematic perspective view of a transverse brace (i.e., a cross brace) having perpendicularly oriented flanges.

DESCRIPTION OF THE INVENTION

Figures 1, 2:
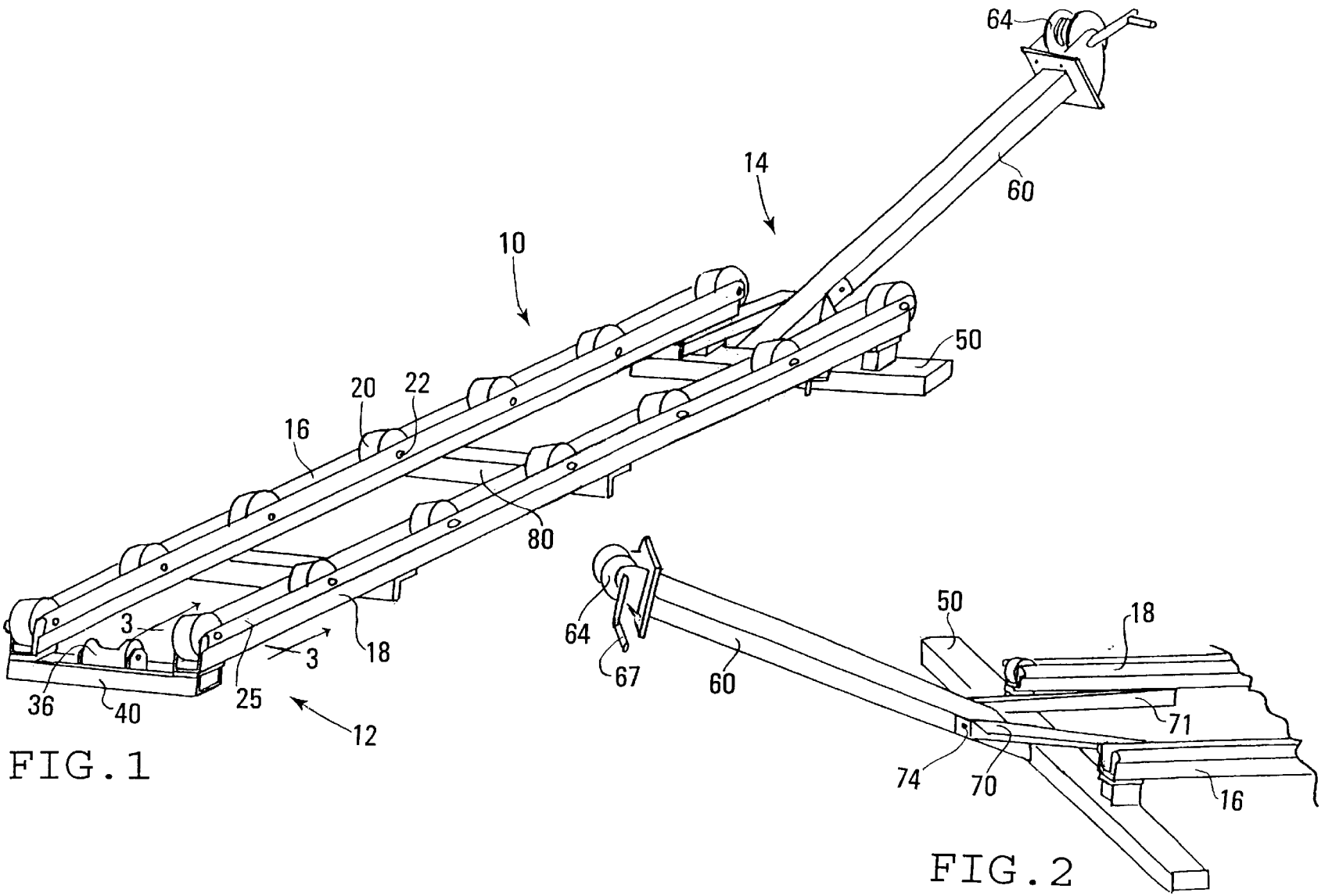
FIG. 1 is a schematic perspective view of an overall ramp of the invention in assembled condition.
FIG. 2 is a schematic perspective view of the shore end of the ramp (with roller wheels omitted) taken at a different angle from that of the perspective view in FIG. 1.

Although the invention may take specific forms varying to some extent from the forms illustrated in the drawings, the most ideal practice of the invention will fairly closely follow the details variously illustrated in the drawings.

For convenience and clarity in describing significant features of the invention, each major assembly making up the total dock or ramp teaching of the invention will be especially emphasized.

The first assembly of the ideal portable watercraft dry-docking and launching ramp is a watercraft-supporting assembly 10 having what is called a water end 12 and a shore end 14 (see FIG. 1).

The watercraft-supporting assembly has a pair of rails 16 and 18. Hull-supporting wheels 20 are mounted on the rails, and for convenience of discussing the details of the rails as well as the mounting of the wheels on the rails, reference will be made particularly to FIGS. 1 and 3. The rails 16 and 18 are most ideally formed by extrusion and have a U-shape. Aluminum is an excellent metal to use in forming the rails although other metals may optionally be used. It is even conceivable that plastic materials may have the necessary characteristics for rails. Rails of U-shaped cross-section have upstanding side walls 24 and 26 on each side of a floor or floor wall 30. The side walls 24 and 26 of the U-shape are higher above their juncture to the internal surface of the floor 30 than the width between the side walls (or width of the floor that extends between the side walls).

Hull-supporting roller wheels 20 have a greater diameter than the height of the side walls 24, 26 of the rails. The wheels 20 are rotatably mounted on axles 22 extending between the side walls 24, 26 of the rails. Actually, the axles 22 are ideally located near the upper edge of the side walls of the rails and are ideally located in a band 25, 27 of extra thickness (or a band of built-up material) as a reinforcement at the upper portion of the side walls. The build-up 25 and 26 of material at the upper edge of the side walls 24 and 26 has two functions: One is to provide a very secure and strong anchoring for the axles 22 of the wheels 20, and the other is to enhance the structural strength of the rails so that they are highly resistant to being bent downwardly at any location along their length.

Optionally, the axles 22 for the hull-supporting roller wheels 20 may be formed by using shafts equipped with a head 32 and a friction cap 34 at the opposite end, as illustrated in FIG. 3. Friction capped axles are faster to install than those employing threaded bolts, and friction caps are more economical; but bolts and nuts are somewhat more reliable without suffering damage under ramp use conditions and thus are preferred for use as axles. (Of course, other fastening approaches and axle styles may be employed without deviating from the inventive concepts of the invention.)

The rails 16 and 18 are of equal length (or substantially so) and are not only laterally spaced apart but extend in a parallel relationship between the water end and shore end for the rails. The lateral spacing of the rails preferably should be at least about 10 or 12 inches on center. Put another way, the lateral space between rails should always be at least about 8 or 9 inches and may be as great as up to about 2 feet. (The spacing distance can vary depending on the shape of the hull of watercraft to be supported by the ramp.) The length of the rails should be at least about 7 feet and preferably is not any longer, or is less, than about 9 feet for easy packaging for shipping. Longer rails up to about 14 or even more feet can be useful under certain conditions, especially where the lake floor (i.e., earth or land mass) slopes ever so slightly to greater and greater depth underwater. As the distance from the shore line increases, longer rails are then needed in order to extend the rails of the ramp to greater distances into water from the shore line so as to be able to dock watercraft on the ramp while retaining buoyancy for the watercraft. (As used herein, "watercraft" means a craft having a hull for floating in water. Thus "watercraft" is a term that includes boats as well as personal watercraft.)

For most shore areas and most personal watercraft, the rails for ramps of the invention need not be greater than about 8 or 9 feet and may be as short as about 7 feet (but not really significantly shorter than 7 feet). The best lighter weight material should be employed for the ramp in order to get reduction for the total weight of the complete ramp structure; and reduction of weight means savings in shipping as well as ease of handling and movement of the ramp structure to locations of choice along a shoreline.

Figure 14:
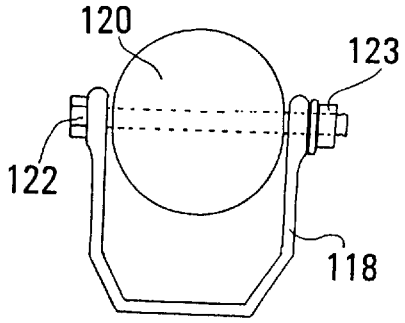
FIG. 14 is a schematic cross-section of a rail of the ramp, particularly illustrating a varied form for the U shape for the rail and a roller wheel of essentially ball shape, that is, with its greatest wheel circumference in an imaginary plane perpendicular to its axis and located midway between its axial ends—and with the wheel circumference gradually reducing as the plane of measurement is moved toward axial ends for the wheel.

The roller wheels 20 may vary in diameter but preferably have a diameter greater than the height of the side walls of the rails. These wheels are rotatably mounted on axles extending between the side rails and the wheels themselves extend within the U-shape of the side rails. The wheels are in spaced relationship along the length of the rails and that spaced relationship ideally may be about 16 inches on center. The lengthwise spacing should be at least about 12 inches, and generally no more than about 20 inches along the rails. The wheels 20 must extend above the opening of the U-shape of the rails, and preferably the extension of wheels 20 above the opening of the U-shape of the rails will be at least about one-fourth of the diameter of the wheels. Thus, although the wheels may have a diameter barely greater than the height of the side walls of the rails above the internal floor of the rails, the preferred projection of the wheels above the opening of the U-shape in order to satisfy the criteria of easily protecting watercraft hulls from scraping damage—should be at least about one-fourth the diameter of the wheel. Wheels having a diameter barely above the height of the side walls of the U-shape may project above the wide walls little more than about one-fourth the height of the rail side walls. A lesser projection may sometimes be useful but may introduce some risk of hull damage by a rail. Since the style of wheels can vary, and some styles may approach the nature of a ball-shaped wheel (e.g., see FIG. 14), the term diameter as here discussed should be recognized as referring to the part of a wheel exhibiting the maximum or greatest diameter.

A further characteristic at the water end of each side rail is that the circumference of the water end wheels should preferably project outward beyond the water end of the rails in order to save against hull damage to watercraft that might otherwise abut against the very end of the rails at the water end. A one-fourth diameter projection is quite sufficient. Thus, both a circumference projection outward from the water end of the rails as well as the upward projection above the rails is useful for the wheels 20 at the water end 12.

The U-shaped rails or channels 16, 18 generally need not have a width between side walls or a floor width (whether the floor is flat or curved or otherwise) greater than 3 inches, and generally the width need not be greater than 2 inches. That width preferably can be somewhat less but not greatly less than about 1.5 inches (with a lower limit of minimum width of about 1 inch). The height of the side walls for the U-shape for the rails should exceed about 2 inches above the internal surface of the floor at the connection of the side rail to the floor, and generally the height of the side walls will be in excess of 2.5 inches above the connection of the side wall to the internal surface of the floor and even as great as 3 inches above the connection of the side wall to the interior surface of the floor. Of course, U-shaped channels outside the measurements specified can be employed, although those with side walls having a height less than 2 inches are not likely to possess the necessary strength for support of watercraft without bending (especially if foundational support for the rails themselves is limited to the water and the shore ends).

The water end support assembly for the new docking ramp has a rather unique character. First of all, it is a transverse footprint structure 40 that not only serves as a support for the water end of the rails but also as a bracing and thus is properly called a transverse footprint brace 40. The footprint brace is adapted to rest on the lake floor under the water either immediately adjacent to, or out in the water from, the shoreline. A very useful footprint brace has an upstanding U-shape in cross-section (see FIG. 4), with upstanding side walls 42, 43 on each side of a floor 44. For the footprint brace, the best approach is to employ upstanding side walls that are slightly lower in height than the width between the upstanding side walls (or width of floor 44).

The transverse footprint brace 40 need not be greater in its transverse length than the distance between the external (i.e., outer) edges of the rails, but a longer length, while undesirable, is permissible, even a length projecting laterally outward from each side rail. Ideally, the footprint brace does not have any significant transverse length greater than the distance between the external edges of the rails. This permits significant saving of material, especially when it is realized that the footprint brace combines the bracing function with the footprint function. A variety of different shapes may be employed for the footprint brace, but the U-shape discussed is very useful and effective. Still further, for convenience of solid attachment. as by bolting to the water end of the rails 16 and 18, plate members 46 and 47 may be welded across the top of the U-shaped footprint brace at each end (or at locations such that the holes 41 for bolting against the underside of the rails are in proper registration or alignment). Top plates 46 and 47 are ideally welded to the upstanding edges of the side walls of the U-shaped footprint brace 40.

Significantly, the rails 16 and 18 most ideally will have floors with a flat internal and external surface for easy bolting assembly of components (e.g., footprint brace 40, cross braces 80, etc.) as discussed herein.

Ideally, the distance between the underside of the rails 16 and 18 and the underside of the footprint brace 40 is less than the distance between the underside of the rails 16 and 18 and the top of the hull-supporting wheels 20 at the water end. This contributes fabulously to an extremely low profile of support for the water end of the watercraft-supporting assembly of the docking ramp.

An optional but preferred feature for the transverse footprint brace 40 is that of a keel roller structure. For example, a bracket or brackets 48 and 49 may be anchored as by welding or the like within the U-shape of the footprint brace at a central location between its ends (i.e., between the rails), and a keel roller 36 may be mounted on a shaft extending through holes 45 of a bracket formed of parts 48 and 49. The bracket 48, 49 and the holes 45 for the axle or shaft of the keel roller should be so oriented that the keel roller properly functions as a keel protector to save the keel of watercraft from hitting the shore end cross member formed by the footprint brace. To some extent, this is most ideally accomplished by positioning the holes 45 for the keel roller shaft above the top surface of the upstanding side walls of the illustrated footprint brace.

The shore end of the rails is supported by a shore end support assembly, which is also characterized by having a footprint feature. The shore end support assembly has a transverse footprint stabilizer bar of a transverse length greater than the distance between the rails 16 and 18. The transverse length should exceed two feet but be not more than four feet. This stabilizer bar is adapted to rest on earth along the shore. A useful stabilizer bar 50 is one of rectangular cross-section with a hollow interior. Holes 51 (see FIG. 5) extend through the hollow rectangular bar and are available for bolt mounting of the base end of a beam for a winch. In FIG. 5, blocks 52 and 54 are in a spaced relationship matching that for the rails 16 and 18 of FIG. 1, and these stub blocks 52 and 54 are suitably welded to the stabilizer bar 50. The reason for blocks 52 and 54 is simply to provide a slight elevation but nothing of any great significance at the shore end—just in case the grading of the slope from the water line itself upward and away from the water line may be significantly rough. The slight elevation also provides room for the brace arms 70 and 71 for the stabilizer bar to pass over the stabilizer bar on their way to mounting locations on the watercraft-supporting assembly. Absolutely minimal elevation is needed at the land or shore end, and thus the stub elevational means 52 and 54 need provide no more elevation than a few inches such as from 2 to 3 inches up to 4 or 5 or 6 inches. Of course, greater elevations are permissible, but not at all desired. Capping each stub elevational means 52 and 54 are plate members 56 and 58 respectively, each with holes 57 and 59 respectively for bolt attachment to the underside of the shore end of the rails 16 and 18.

The result is a very modest elevation for the shore end of the ramp. Interestingly, the distance between the upper end of the capped elevational blocks 52 and 54 and the bottom of the stabilizer bar should not exceed about 1 foot, although larger distances or elevations may sometimes be used, but without significant benefit. Ideally, the distance between the capped elevational blocks 52, 54 and the bottom of the stabilizer bar may be as low as about 6 inches or so.

A preferred feature of the shore end support assembly is that it should be removably mounted to the underside of the rails at a location proximate to the shore end of the rails so as to support the rails and maintain their spaced relationship at the shore end.

The loading assembly for docking watercraft onto the ramp suitably has a winch support beam 60 capable of being mounted and supported in a cantilevered outward direction from the shore end of the rails. The cantilevered direction from the shore end of the rails is in an angular relationship to the length of the rails, but that angular relationship to the length of the rails is closer to being parallel with the length of the rails than perpendicular to that length. Thus, the angular relationship to the length of the rails for the cantilevered outward direction is less than 45 degrees, and preferably less than 35 degrees (or even less than 30 degrees) from a line representing a continuation of the length of the rails. In fact, an ideal angular relationship to the rails is about 20 degrees up from a line representing a continuation of the length of the rails. The best angular relationship is astonishingly low as compared to what appears to be past common practice.

The winch support beam 60 is removably mounted to the stabilizer bar 50 by means of a lateral or transverse plate 62 welded across the base or foot end of the beam 60. The plate 62 is welded to the foot end and is provided with a bolt mounting hole 63 on each laterally projecting portion of plate 62. Only one laterally projecting portion 62 with bolt hole 63 is shown in FIG. 6; the other laterally projecting portion and the bolt hole in it are not visible in the view of FIG. 6. The bolt mounting holes 63 are for passing bolts therethrough and through holes 51 of the stabilizer bar 50 when the winch beam 60 is mounted on the stabilizer bar 50. The winch 64 with winch handle 67 is carried on or mounted to a the winch base plate 66 which is in turn mounted or welded to the winch end or outer end of the beam 60.

The length of the winch mounting beam 60 should be kept within bounds and preferably will not exceed about 4 feet, with a better length being around 3 or 3.5 feet, and always over 2 feet.

The cantilevering of the winch support beam permits utilization of the entire length of the rails for full support. The cantilever for the winch support beam and its low angle relationship to the rails permits the watercraft-supporting assembly to be relatively short (e.g., 8 feet or so) and still support watercraft having hulls of equal or even greater length, with the bow end extending out beyond the shore end of the rails and over at least one-half (even at least three-fourths) the length of the winch support beam without any interference by the winch support beam.

Bracing the winch support beam 60 against lateral movement and in a manner to avoid conflict between other bracing and support assemblies for the ramp led to the formation of angle brace arms 70 and 71; see FIG. 7. Brace arms 70 and 71 are formed of perpendicularly oriented flanges 72 and 73 (e.g., an angle iron shape). At one end they are equipped with angled mounting plates 74 and 75 containing holes 76 and 77 for bolt mounting to sides of the beam 60 through mounting hole 68 that extends through beam 60. Braces 70 and 71 extend angularly from beam 60 (i.e., they fan out) in a direction over the stabilizer bar 50 toward lateral locations on the watercraft-supporting assembly such as, for example, on rails 16 and 18 where they are mounted to the underside of the rails. (As aforenoted, the slight elevation for the shore end of the rails as provided by the stub blocks of the stabilizer bar 50 permits brace arms 70*p* and 71 to easily pass over the stabilizer bar 50 on their way to a mounting on the watercraft-supporting assembly.) Bolt holes 78 and 79 are provided for mounting of the angular brace arms 70 and 71 to the underside of rails 16 and 18. Their location of bolt mounting to the underside of the rails 16 and 18 is inward from the shore end of the rails (i.e., at a location on the rails that is closer to the water end than the mounting for the stabilizer bar 50 to the shore end of the rails). Other lateral locations on the watercraft-supporting assembly for mounting brace arms 70 and 71 may comprise a cross brace between rails, especially the first cross brace located inward from the stabilizer bar 50 at the shore end terminus of the watercraft-supporting assembly.

To maintain stability and brace the rails 16 and 18 at a fixed distance from each other, it is suitable to employ any number of cross braces of angle iron shape such as cross brace 80, and bolt the cross brace to the rails 16 and 18 through bolt holes such as at 82 and 84.

It is particularly interesting to note that the rails at the shore end are maintained in spaced relationship by the shore end support assembly for the rails, namely the transverse footprint stabilizer bar and its stub blocks. The arrangement is exceedingly effective to prevent torsional shifts of the rails as a watercraft is loaded on the ramp using the loading mechanism of a winch, whether hand powered or electrically powered, etc. The cantilevered winch support beam mounted to the footprint stabilizer bar and braced to the rails is rendered exceedingly resistant against torquing movements during winch action and in fact contributes to stability for the entire assembly as winching takes place.

The new ramp has an exceedingly low profile for use yet has an effective arrangement of elements that permits docking of a watercraft without fuss and with relative ease. The watercraft will roll smoothly down the ramp into the water. The design allows for easy keel centering of a watercraft during docking while the watercraft is buoyantly floating. The extremely low profile reduces what might be called the fulcrum effect and reduces the strength needed to dock the watercraft. By distributing the stress of the watercraft on the ramp to side rails or beams, great stability is achieved for the docking and launching operations. An extremely significant feature is that of the simple structure for the ramp and yet an exceedingly effective bracing against torsional forces.

Variations of structural features of the invention are quite possible without departing from the inventive concepts behind the invention; and some illustrative variations will now be described.

Figure 9:
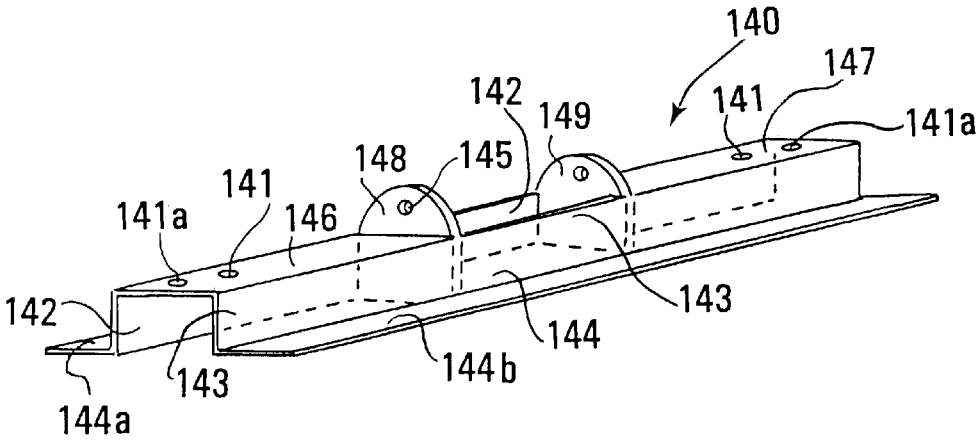
FIG. 9 is a schematic perspective view of a modified form of a transverse footprint brace for the water end of the ramp.

The transverse footprint brace for the water end may be designed for casting, in which event it may have a structure 140 such as illustrated in FIG. 9. Avoidance of hollow conduits or the like is desirable for casting purposes and thus the design of a footprint base for the water end may have outwardly extending flanges or feet 144*a* and 144*b* for resting on the earth under water, with the flange feet merging into elevational side walls 142 and 143. A top platform or plate 146 and 147 at each end has holes in it for assembly or mounting to the underside of rails. The inner set of holes 141 at each end is used for bolt or equivalent mounting to rails where the spacing desired between the rails is less than the spacing effected when the outer set of holes 141*a* is used for bolting to the rails. (A hole through a rail floor at the water end can be used for either inner or outer mounting to the footprint brace 140.) The central portion of the footprint brace 140 carrys a bracket or brackets 148 and 149 with holes 145 for mounting the axle of a keel roller and holding the keel roller above a floor 144 between the side walls 142 and 143 as they extend between the brackets 148 and 149.

Figure 10:
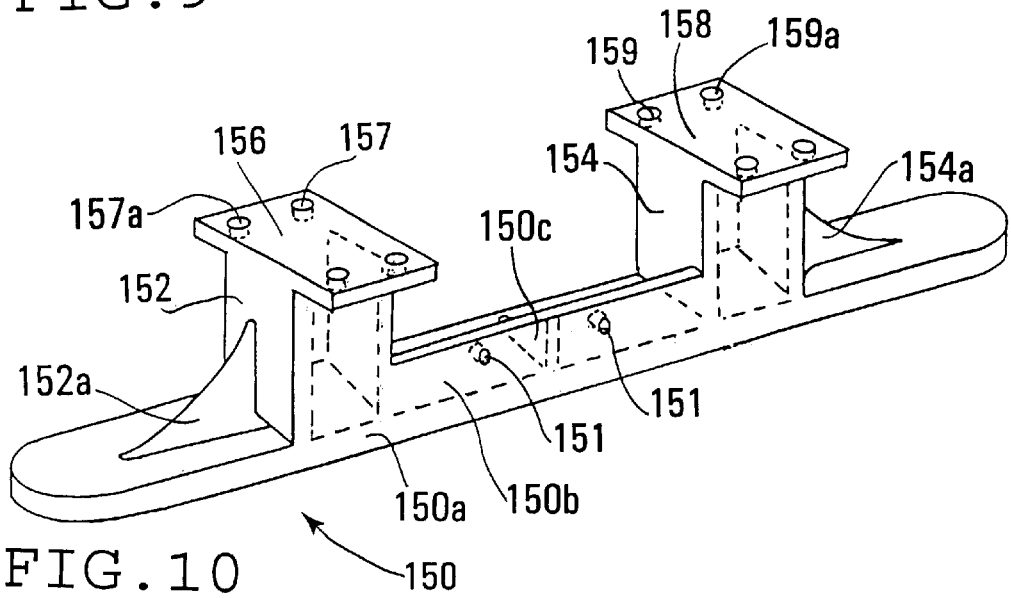
FIG. 10 is a schematic perspective view of a modified form for the shore end support assembly, that is, the transverse footprint stabilizer bar and its stub elevations topped with mounting plates for bolting the assembly to the shore end of the rails.

FIG. 10 illustrates a suitable modified style for a transverse footprint stabilizer bar 150 for the shore end. It has stub elevational means 152, 154 (e.g., stub columns or pillars or blocks) and top flange plates 156, 158 for mounting of the bar 150 under the rails at or proximate to the shore end. Here the formation of the part unites the features of the entire stabilizer bar into a unitary whole presenting an elongated base 150*a*, stub pillars 152, 154 supported by flying buttresses 152*a* and 154*a* at each end and having a connecting side wall 150*b* on which a winch support beam can be mounted at holes 151. The side wall 150*b* extends between the elevational means 152, 154 and is braced by buttress 150*c*. At the top of the stub elevational means are the appropriate mounting plates 156, 158 carrying inner holes 157, 159 and outer holes 157*a* and 159*a* that permit a variation of the spacing between the rails as the rails are mounted to the top of the stub elevational means. The inner set of holes 157, 159 will be used for minimal spacing for the rails, whereas the outer set 157*a*, 159*a* will be used for maximum spacing for the rails. The stub elevational means (e.g., stub pillars) may be hollowed out from the back side for casting purposes.

Figure 11:
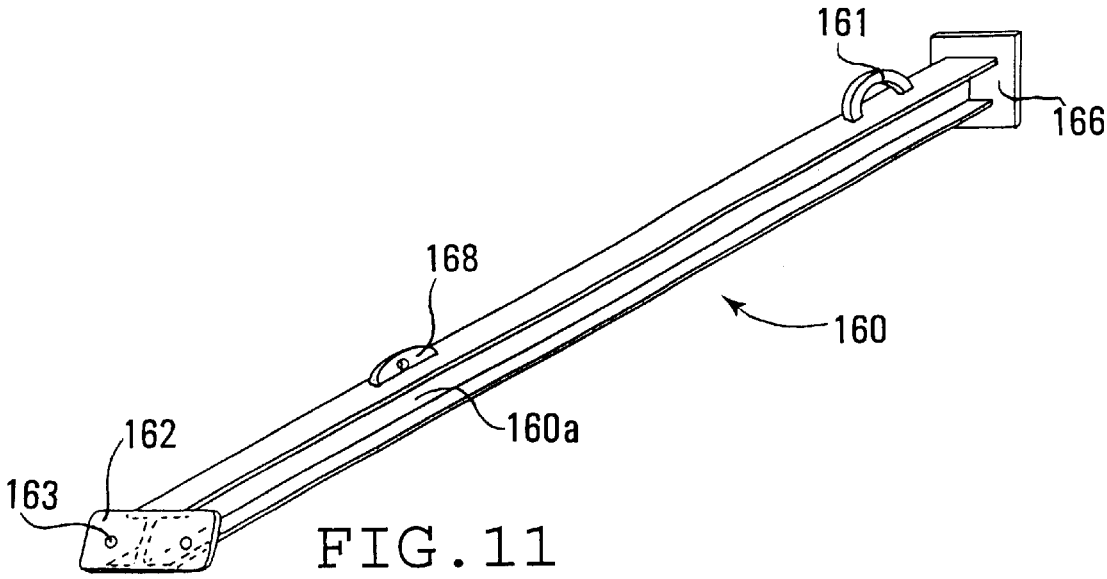
FIG. 11 is a schematic perspective view of a modified form for the winch support beam for the ramp.
Figure 12:
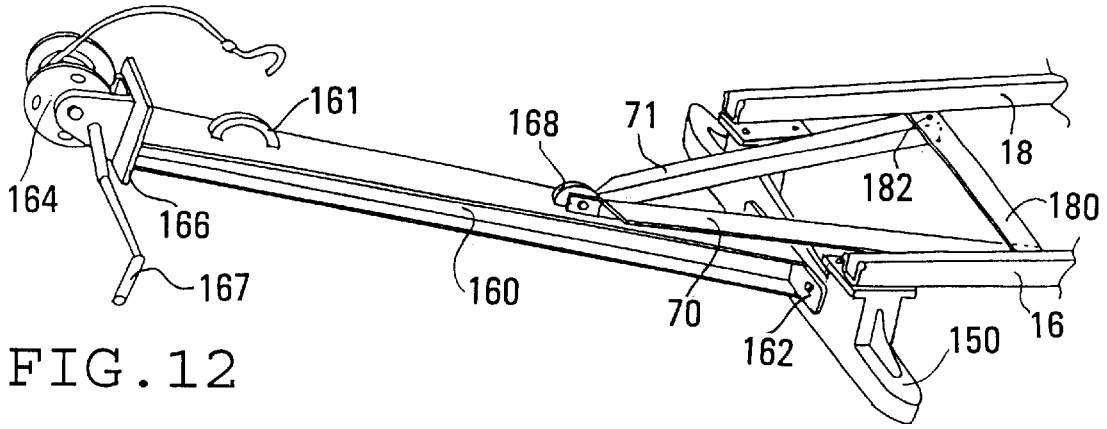
FIG. 12 is a schematic perspective view of the modified winch support beam and other elements at the shore end, particularly illustrating the bracing for the winch support beam (and omitting a showing of wheels on the rails)

A sturdy style for a winch support beam 160 is illustrated in FIG. 11 (and also shown in FIG. 12). An I-beam 160*a* is used to form this winch support beam. The mounting plate 162 at the lower end has bolt holes 163 for mounting or fastening the winch support beam to the stabilizer bar at the shore end, whether the stabilizer bar is one as illustrated in FIG. 5 or in FIG. 10 or some other or further form for it. Mounting plate 166 at the outer end of the winch support beam 160 is for receiving a winch (generally by adding bolt holes for the purpose but optionally by any suitable fastening system). A locking loop 161 on the winch support beam can be used to lock a watercraft to the ramp to inhibit theft. A mounting place or ear 168 with a bolt hole for fastening a pair of bracing arms on opposite sides of the support beam is provided. As illustrated, the I-beam for the winch support beam is shown to have upper and lower flanges, but the possibility exists for a 90-degree shift (e.g., a lateral positioning) of such flanges, in which case the laterally spaced flanges themselves may be equipped with a hole or holes for bolt mounting of bracing arms for the winch support beam.

FIG. 12 shows the winch support beam of FIG. 11 mounted by its mounting plate 162 to a transverse footprint stabilizer bar 150 at the shore end of a watercraft-supporting assembly formed of rails 16 and 18. Wheels 20 are not present in FIG. 12. To the outer end of the winch support beam 160 is mounted a winch 164 (including a winch strap and a hook for latching onto the tow ring at the bow of a watercraft). The winch is mounted on a mounting base plate 166, and this mounting is preferably by bolts or other fasteners so that the winch is removably mounted on the beam 160. Indeed, the handle 167 of the winch is also preferably removably mounted on it. At the ear 168 (and in fact on opposite sides of it) is mounted a pair of brace arms 70, 71 for the winch support beam. They are mounted in opposing relationship to the winch support beam (at its ear 168). From that mounting they fan out angularly as they extend over the stabilizer bar 150 to lateral mounting locations on the watercraft-supporting assembly. The lateral locations may be on the underside of the rails (without connection to a cross brace 180), but preferably are on a cross brace 180, as illustrated in FIG. 12.

Figure 13:
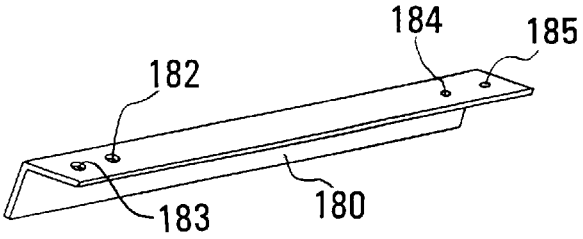
FIG. 13 is a schematic perspective view of a special cross brace (extending transversely) similar to the brace of FIG. 8, but including extra bolt holes to vary the lateral spacing of rails mounted on it.

Please note that the cross brace 180 of angle iron shape as illustrated in FIGS. 12 and 13 is the same as the cross brace 80 illustrated in FIG. 8, except that cross brace 180 is longer and has inner mounting holes 182, 184 for bolting to the underside of the floor of rails to space the rails at a shorter spacing distance and outer mounting holes 183, 185 for spacing the rails apart at a greater distance. The inner end of the bracing arms 70, 71 is ideally mounted to the cross brace 180 in FIG. 12 at its inner mounting holes 182 and 184, regardless of whether rails are also bolt mounted there or on outer mounting holes 183, 185. It is highly preferred to mount the inner ends of the bracing arms 70, 71 for the winch support beam consistently at the inner lateral holes 182, 184 in the cross brace 180. This permits a consistent fanning angle for bracing arms 70, 71. The inner ends of the bracing arms may abut against the depending flange of the angled brace flanges that form the cross brace 180. It is, of course, optional, to vary the inner end mounting of the bracing arms 70, 71 for the winch support beam; but in all instances, the inner ends will be mounted to lateral mounting locations on the watercraft-supporting assembly. Interestingly, the brace arms 70 and 71, as illustrated in FIG. 12, extend almost in a horizontal plane to the cross brace 180 mounting from ear mounting 168.

Hull-supporting roller wheels for the ramp may take a variety of forms. In FIG. 13 is illustrated a form that is essentially in the nature of a ball, although the figure illustrates a slightly flattened ball 120 (e.g., compressed in the axial direction). The maximum circumference for the roller wheel of FIG. 13 is in a plane perpendicular to the axis of rotation and approximately midway between the axial ends or sides of the wheel. The wheel of FIG. 13 has a gradually reduced circumference as one moves from the plane of maximum circumference toward each edge or axial end of the roller wheel. The roller wheel in FIG. 13 may be mounted for rotation on an axial shaft (e.g., a bolt 122 and nut 123) carried in a bracket (which may have the design of 118) and the bracket then mounted on a rail as desired, or the wheel on an axial shaft may be mounted within the U shape 118 of a rail as herein discussed.

Optionally a reinforcing plate may be employed at the mounting of the winch support beam to the stabilizer bar or at other locations.

An important feature for the ideal practice of the invention is that of maintaining disassembled parts of the total structure within the tolerance or limits of size that will permit a package size acceptable to most parcel shipping entities such as the United States Postal Service, United Parcel Service, Federal Express (Fed-Ex), etc. These organizations specify a maximum weight of 70 pounds per package and a maximum size defined as 108 inches (9 feet) as the maximum length and 130 inches for the total of the length plus girth of the package. The design of the new ramp of the invention and the unique arrangement and mounting of the winch support beam contribute mightily to compliance with the package restrictions of the popular parcel shipment organizations, but once in a while an even longer hull-supporting assembly with rails longer than 108 inches or 9 feet may be needed. An illustrative need for such longer rails can arise where the slope of the solid earth under water from the shore line is extremely gradual (as in the case of shallow or tidal shore lines). Under such circumstances, it may be desirable to have the rails of the ramp extend farther out into a body of water so as to permit loading of floating watercraft on the rails at some distance out into the body of water from the shore line while the watercraft hull is floating on the body of the water.

Figure 15:
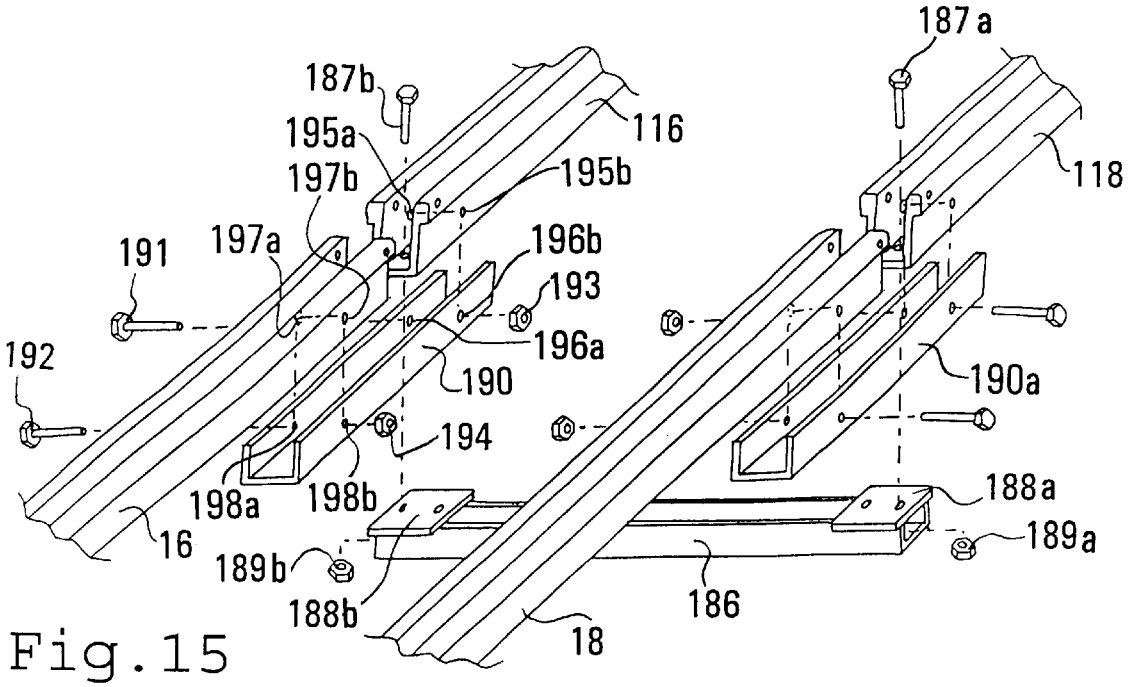
FIG. 15 is a schematic perspective and exploded view illustrating how two rail sections may be joined using a connecting bracket to unite abutting ends of the two rail sections so as to form especially long rails for the invention; this figure also includes a cross support brace for a location proximate to or near the juncture of the rail sections connected by a connector bracket.

A convenient way to form rails of relatively longer lengths, including lengths in excess of 108 inches or 9 feet, is to connect together two rail sections in an end-to-end relationship. Such a connection and the connecting bracket for it as well as the additional base support preferred for it are illustrated in the exploded view of the components in FIG. 15. Only one connection between rail sections to form a longer rail need be discussed in detail. A suitable connecting bracket 190 is one of U-shape having internal surfaces that snugly fit the external surfaces of the U-shaped rails. Rails 16 and 116 are placed together with the ends of each section in abutment at a joint and then the snug U-shaped connecting bracket 190 is pressed upon the exterior of the rails over the joint and secured in position by fasteners such as bolts 191 and 192 that extend through aligned holes of the bracket and rails to nuts 193 and 194. For example, bolt 191 extends through hole 196*a* of bracket 190, then holes 195*a* and 195*b* of rail 116, and finally hole 196*b* of connector bracket 190 to nut 193. Similarly, bolt 192 extends through hole 198*a* of bracket 190, then holes 197*a* and 197*b* of rail 16, and finally hole 198*b* of the bracket 190 to nut 194. A similar arrangement is provided for rails 18 and 118 united by connecting bracket 190*a*.

A footprint cross brace support 186 is ideally mounted to the underside of the connecting brackets 190 and 190*a* at a location proximate to the joint or junction between rail sections. Illustratively, a footprint cross brace support 186 is suitably mounted under the connecting bracket 190*a* by passing a bolt 187*a* through holes in the floor of rail 118 and through connector bracket 190*a* and plate 188*a* of footprint cross brace support 186 to nut 189*a*. Bolt 187*b* with nut 189*b* unites the rail 116 and connecting bracket 190 to a plate 188*b* at the other end of the footprint cross brace 186. The footprint cross brace 186 at this location may resemble a water end footprint brace, but of course, no keel roller or keel roller brackets are needed for the footprint cross brace support mounted for support of the abutting ends of rail sections connected together as discussed.

Additional roller wheels will be distributed along the length of the added rail section in a manner comparable to their distribution as afore-discussed; and, of course, the roller wheels at the extended water end as well as the footprint brace and any keel roller, will all be mounted at the extended water end as afore-described for the water end features.

The importance of packaging acceptable to popular parcel shipping entities cannot be overemphasized. It permits a manufacturer to have inventory at a single location and yet be able to effect speedy delivery of product at acceptable expense to satisfy customer wants almost anywhere.

The ramp teaching of this invention is ideally made of components easily assembled (i.e., mounted) together and easily disassembled (unmounted). Useful components to make up the entire ramp (not including the addition of rail sections to create ramps over 9 feet in length) can total out at a weight of only about 50 pounds, easily below the allowable weight for fast parcel shipment. The equipment for an added length (rails, roller wheels and axles, and footprint cross brace) are easily packaged in a separate carton.

Figure 16:
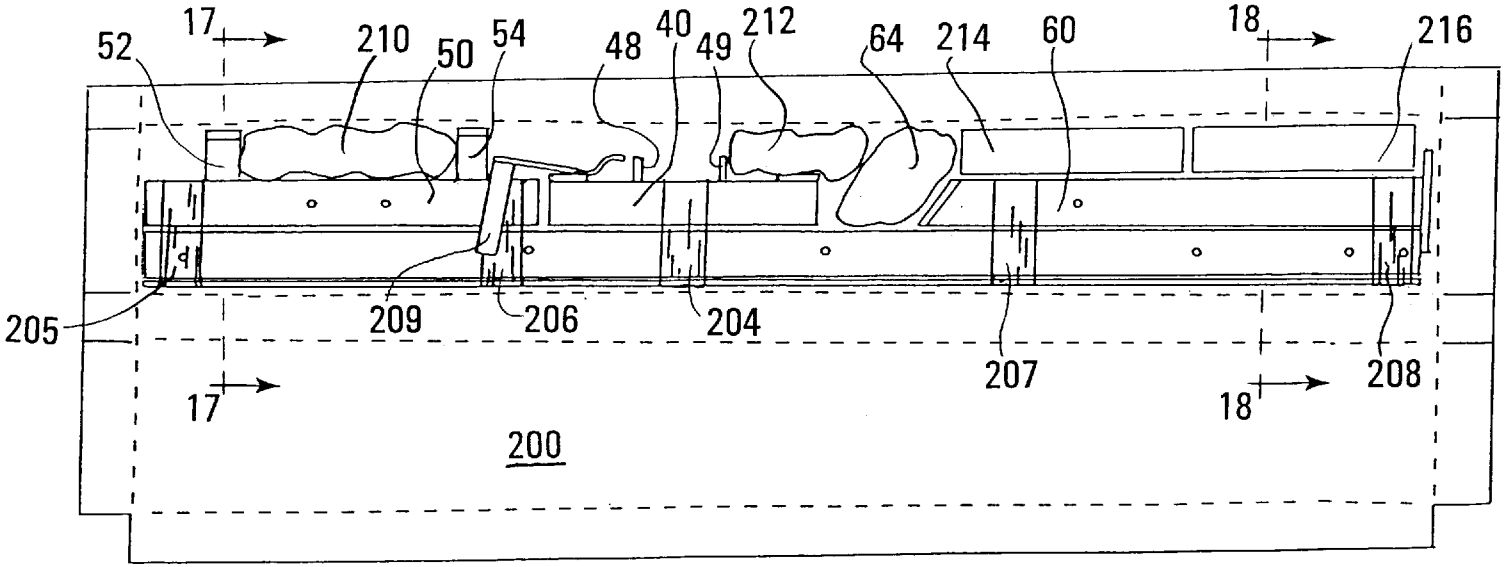
FIG. 16 is a schematic plane view of an open carton illustrating the packaging of components of the ramp in unassembled condition within a shipping box or container of a size acceptable to well-known parcel shipping organizations.
Figure 18:
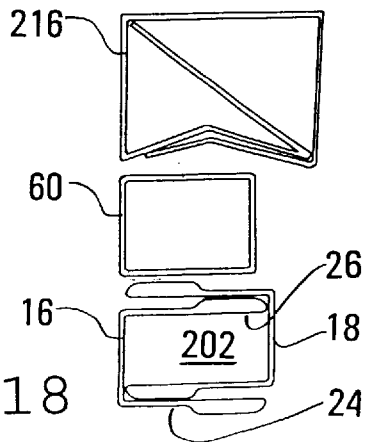
FIG. 18 is a cross-sectional view of components of the shipping box of FIG. 16, taken along lines 18—18 of FIG. 16.
Figure 17:
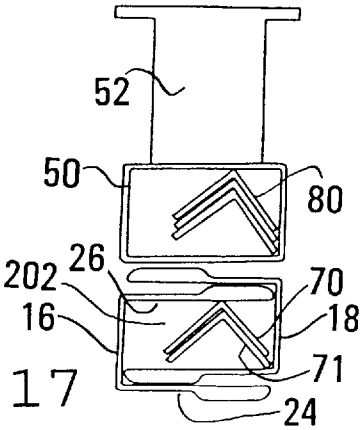
FIG. 17 is a cross-sectional view of components of the shipping box of FIG. 16, taken along the line 17—17 of FIG. 16.

Compact packaging of unassembled components is illustrated in FIGS. 16, 17, and 18. The length of the package may vary between 80 and 108 inches but is preferably around 96 or 98 inches in length. The width of package should be kept within bounds and a width of 8 inches or possibly 10 or even 12 inches and a height of 3, 4, or 5 inches or possibly 6 inches, easily keeps the external dimensions of the package in terms of length plus girth (i.e., girth being two times the height and two times the width) within the limitations of size for parcel shipment by air.

Corrugated cardboard packaging material is ideal. The packaging material 200 (see FIG. 16) is folded along dash lines as illustrated in FIG. 16 about the contents of the package and the matching parts of the packaging material are stapled together. Illustrative contents include two U-shaped rails 16, 18 of 94 inches in length and having side walls (e.g., 24 and 26) no more than about 3 inches in height from the floor of the rail. These rails are placed together with one side wall of each rail inserted within the cavity of the other so that each inserted side wall lies immediately adjacent a side wall of the other rail (see FIGS. 17 and 18). Stated another way, a side wall of each U-shaped rail is interleaved inside the opening of the other so as to place the side walls of each rail in juxtaposition, with the floors of the rails spaced from each other. In this manner, a cavity 202 within the combined rails is formed. Immediately outside and adjacent one side rail is placed an alignment of three major components of the ramp. Those three components are the transverse footprint brace 40 (about 18 inches long) at a central location, a transverse footprint stabilizer bar 50 (about 30 or 40 inches long) at an end part of the alignment, and a winch support beam 60 (about 40 inches long) at the other end of the alignment. Note that the bracket flanges 48, 49 for support of the keel roller are oriented outwardly away from the combined rails, and this permits the smooth side of the footprint brace 40 (or the side having non-projecting elements) to be snugly placed against a side of the combined rails and taped or strapped snugly by tape 204 against the side. Similarly, the stub elevational means or stub blocks 52, 54 of the footprint stabilizer bar 50 are oriented to extend outwardly away from the combined rails, and this enhances the ability to tape or strap 205, 206 the stabilizer bar against a side of the combined rails. Further, the winch support beam 60 is oriented with a side of it against the combined rails and taped or strapped 207, 208 in position.

Within the elongated cavity of the combined rails is a space that is readily usable for inserting other components such as bracing arms 70, 71 for the winch support beam, and/or cross braces of angle iron nature. In the event the transverse footprint stabilizer bar for the shore end of the ramp is of a design such as illustrated in FIG. 5 (i.e., with hollow interior), the option exists to insert the cross braces 80 of angle iron nature and even bracing arms for the winch support beam into the hollow interior of such a stabilizer bar.

The winch 64, including its strap or rope and any hook or loop associated with it, can easily be placed in an enclosure such as in a padded plastic bag (if desired) and fitted within a space between the transverse footprint brace 40 and winch support beam 60 and be placed snug against the side of the combined rails, although a removable crank handle 209 for it can be lodged in almost any crevice location of the package. Small items—such as a keel roller and axle for it, a group of about 12 or 14 roller wheels and axles for the same, a number of bolts and nuts and washers as needed for assembly, and any instructions for assembly, as well as anything else that might be helpful for assembly of the components—are suitably placed in bags or pouches 210, 212 and lodged in the shipping package at any location having sufficient space for the same, of which there are many remaining. In fact, the space adjacent the outer side of the winch support beam 60 is illustrated as being occupied by folded cardboard 214, 216 to maintain a snug condition for components in the corrugated cardboard shipping box. (It should be noted that the illustrations of FIGS. 16, 17, and 18 show spacing between components; and the reason for the spacing is to give clarity to the component packaging for each part or component.

The new watercraft ramp of the invention has great simplicity of parts and an ideal interrelationship between parts. The result is a ramp of not just extraordinary simplicity, but one extremely easy to use, and fast to use, both for docking and launching of watercraft. The slight elevation preferred for the shore end gives comfort for winch use even when exceedingly low angles are chosen for the cantilever of the winch support beam. Further, the cantilever of the winch support beam provides a gain for the overall length of the ramp while maintaining minimum rail length as desired for shipping purposes. Roller wheels recessed within U-shaped rails and the recessed condition for the keel roller within the U-shape for the transverse footprint brace at the water end allow for the lowest possible profile for the hull-supporting members of the watercraft-supporting assembly.

Further, those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A watercraft ramp comprising:

(i) a watercraft-supporting assembly having a pair of rails of substantial equal length braced in parallel laterally spaced-apart relationship by cross braces so that said rails are separated at least 8 inches apart from each other, each said rail being equipped with a plurality of hull-supporting roller wheels mounted on said rails in spaced condition along the length of said rails, said watercraft-supporting assembly having one end called a water end and the other end called a shore end, (ii) a water end support assembly having a transverse footprint brace mounted to the underside of said rails at a location proximate to said water end, (iii) a shore end support assembly having a transverse footprint stabilizer bar mounted to the underside of said rails at a location proximate to said shore end in a manner such that said mounting is inward from the outer ends of said stabilizer bar, and (iv) a loading assembly having a winch support beam mounted rigidly to said transverse footprint stabilizer bar so that said winch support beam is upwardly cantilevered out beyond the shore end of said rails in an angular relationship to the length of said rails, said angular relationship being closer to a parallel relationship to said rails than a perpendicular relationship to said rails.

2. The ramp of claim 1 wherein said loading assembly additionally includes a pair of brace arms for said winch support beam, said pair of brace arms being mounted in opposing relationship to said winch support beam and then fanning out therefrom as they extend over said stabilizer bar to lateral mounting locations on said watercraft-supporting assembly.

3. The ramp of claim 1 wherein said transverse footprint stabilizer bar has a transverse length greater than the lateral spacing distance between said rails.

4. The ramp of claim 1 additionally including stub elevational means on said stabilizer bar at the location of the mounting of said stabilizer bar to the underside of each said rail.

5. The ramp of claim 1 additionally including a winch mounted to the outer end of said winch support beam.

6. The ramp of claim 1 wherein said water end of each said rail is equipped with a said roller wheel so mounted that a portion of the circumference of said water end roller wheels projects outward beyond the water end of said rails as well as upward above the water end of said rails.

7. The ramp of claim 1 wherein said water end support assembly additionally includes a keel roller mounted on said footprint brace at a central location between said rails so that at least a portion of the circumference of said keel roller projects above said footprint brace.

8. The ramp of claim 1 wherein said rails of said watercraft-supporting assembly have a U-shape with upstanding side walls on each side of a floor, the side walls of the U-shape being higher above the floor of the U-shape than the width between said side walls, and wherein said roller wheels are rotatably mounted on axles extending between said side walls so that at least a portion of the circumference of each said roller wheel projects above said side walls of the U-shape of said rails.

9. The ramp of claim 1 wherein the distance between the underside of said rails and the underside of said transverse footprint brace at said water end is less than the distance between the underside of said rails and the top of said roller wheels at said water end.

10. The ramp of claim 1 wherein said lateral space between said rails is up to about 2 feet and wherein said rails have a length of at least about 7 feet.

11. The ramp of claim 1 wherein the distance between the underside of said rails and the underside of said transverse footprint brace of said water end is less than the distance between the underside of said rails and the underside of said transverse footprint stabilizer bar of said shore end.

12. The ramp of claim 1 wherein said angular relationship of said winch support beam to the length of said rails is no greater than 35 degrees.

13. The ramp of claim 2 wherein said lateral mounting locations on said watercraft-supporting assembly for said brace arms of said winch support beam are on a cross brace of said watercraft-supporting assembly, and wherein said mounting of said winch support beam is such as to permit the bow end of a watercraft on said ramp to extend out beyond the shore end of said rails and over at least one-half the length of said winch support beam without any interference by said winch support beam.

14. The ramp of claim 2 wherein said lateral mounting locations on said watercraft-supporting assembly for said brace arms of said winch support beam are on the rails of said watercraft-supporting assembly, and wherein said mounting of said winch support beam is such as to permit the bow end of a watercraft on said ramp to extend out beyond the shore end of said rails and over at least one-half the length of said winch support beam without any interference by said winch support beam.

15. The ramp of claim 1 wherein said transverse footprint brace for the water end has outwardly extending flange feet.

16. The ramp of claim 1 wherein said transverse footprint stabilizer bar for the shore end has a buttressed side wall equipped with holes for bolt mounting to said winch support beam thereto.

17. The ramp of claim 1 wherein each said rail of said pair comprises two rail sections with an end of one said section abutting an end of the other said section and a connecting bracket extending over said abutting ends and supported by a footprint cross brace.

18. A watercraft ramp comprising:

(i) a watercraft-supporting assembly having a pair of rails of substantial equal length braced in parallel laterally spaced-apart relationship by cross braces, said rails each having a U-shape with upstanding side walls on each side of a floor, the side walls of the U-shape being higher above the floor of the U-shape than the width between said side walls, said rails being equipped with hull-supporting roller wheels rotatably mounted on axles extending between said side walls so that at least a portion of the circumference of each said roller wheel projects above said side walls of the U-shape of said rails, said roller wheels being in spaced condition along the length of said rails, said watercraft-supporting assembly having one end called a water end and the other end called a shore end, (ii) a water end support assembly having a transverse footprint brace mounted to the underside of said rails at a location proximate to said water end, (iii) a shore end support assembly having a transverse footprint stabilizer bar equipped with stub elevational means at which said bar is mounted to the underside of said rails at a rail location proximate to said shore end, said transverse footprint stabilizer bar having a transverse length greater than the lateral spacing distance between said rails, and (iv) a loading assembly having a winch support beam mounted to said transverse footprint stabilizer bar so that said winch support beam is upwardly cantilevered out beyond the shore end of said rails in an angular relationship to the length of said rails, said angular relationship being closer to a parallel relationship to said rails than a perpendicular relationship to said rails, and having a pair of brace arms for said winch support beam, said pair of brace arms being mounted in opposing relationship to said winch support beam and then fanning out therefrom as they extend over said stabilizer bar to lateral mounting locations on said watercraft-supporting assembly.

19. The ramp of claim 18 wherein said water end of each said rail is equipped with a said roller wheel so mounted that a portion of the circumference of said water end roller wheels projects outward beyond the water end of said rails as well as upward above the water end of said rails.

20. The ramp of claim 18 wherein said water end support assembly additionally includes a keel roller mounted on said footprint brace at a central location between said rails so that at least a portion of the circumference of said keel roller projects above said footprint brace.

21. The ramp of claim 18 wherein the distance between the underside of said rails and the underside of said transverse footprint brace at said water end is less than the distance between the underside of said rails and the top of said roller wheels at said water end.

22. The ramp of claim 18 wherein said angular relationship of said winch support beam to the length of said rails is no greater than 35 degrees.

23. A package of unassembled components capable of convenient assembly to form a watercraft ramp, said unassembled components comprising:

(i) components for forming a watercraft-supporting assembly having a water end and a shore end, said components of said watercraft-supporting assembly comprising (a) a pair of U-shaped rails each having upstanding side walls on each side of a floor, wherein the side walls of the U-shape are higher above their juncture to the floor of the U-shape than the width between said side walls, said rails having a length of at least about 7 feet, but not more than about 9 feet, (b) cross braces adapted for removable fastening to said rails to hold said rails in a laterally spaced parallel relationship, (c) hull-supporting roller wheels and axles for said wheels, said wheels being adapted to be removably mountable on said axles and said axles being adapted to be removably mountable between said side walls of said rails in a spaced relationship along the length of said rails, with a portion of the circumference of each said hull-supporting wheel so removably mountable as to extend above the opening of the U-shape of said rails and with said hull-supporting wheels at the water end of each said rail being adapted to be removably mountable so that a portion of the circumference of said water end wheels projects outward beyond the water end of said rails as well as upward above the water end of said rails, (ii) components for a water end support assembly for said rails, said water end components consisting essentially of a transverse footprint brace adapted to be removably mountable to the underside of said rails at a location proximate to said water end, said footprint brace being equipped with a keel roller bracket, and a keel roller and an axle for the same adapted to be removably mountable on said keel roller bracket of said footprint brace, (iii) components for a shore end support assembly for said rails, said shore end components including a transverse footprint stabilizer bar having a transverse length greater than the distance of spacing between said rails, said stabilizer bar being adapted to be removably mountable to the underside of said rails at a location proximate to said shore end of said rails so as to support said rails and maintain their spaced relationship at said shore end, and (iv) components for a loading assembly, said loading assembly components including a winch support beam capable of being removably mountable to said stabilizer bar in a cantilevered outward direction from the shore end of said rails at an angular relationship to the length of said rails, said angular relationship being closer to a parallel relationship to said rails than a perpendicular relationship to said rails, and a pair of brace arms capable of being removably mountable to said winch support beam and said watercraft-supporting assembly so as to brace said winch support beam in said cantilevered direction.

24. A package containing compactly packaged unassembled components for convenient assembly by a customer-user to form a watercraft ramp, said package having a weight no greater than 70 pounds and having a length dimension between 80 and 108 inches, and having a length plus girth dimension not over 130 inches, said unassembled components comprising:

i) components for forming a watercraft-supporting assembly having a water end and a shore end, including (a) a pair of U-shaped rails each having upstanding side walls on each side of a floor, with the side walls of the U shape higher above their juncture to the floor of the U shape than the width between said side walls, said rails being of substantially equal length with said length being greater than 7 feet and less than 9 feet, (b) at least three cross braces for mounting to said rails to brace said rails in a parallel laterally spaced apart relationship of at least about 8 inches and up to about 2 feet, and (c) at least 12 hull-supporting roller wheels and accompanying axles for said roller wheels, said wheels being capable of being rotatably mounted on said axles and said axles being capable of being mounted between said side walls of said rails in a manner causing a portion of the circumference of each said hull-supporting wheel to extend above the opening of the U shape of the rails, ii) components for a water end support assembly for said rails, including a transverse footprint brace capable of being mounted to said rails at said water end to not only maintain the spaced relationship of said rails at said water end but also to provide a footprint for support of said water end of the watercraft-supporting assembly, iii) components for a shore end support assembly for said rails, including a footprint stabilizer bar having a transverse length greater than the distance between said rails as established by said cross braces of said watercraft-supporting assembly, said stabilizer bar being mountable to the underside of said rails at said shore end and being capable of effecting a greater elevation of said rails at said shore end than any elevation effected for said rails by said water end support assembly, and iv) components for a loading assembly at said shore end, including a winch support beam removably mountable to said stabilizer bar in a manner causing said winch support beam to be upwardly cantilevered out beyond the shore end of said rails in an angular relationship to the length of said rails, said angular relationship being closer to a parallel relationship to said rails than a perpendicular relationship to said rails, and a pair of brace arms removably mountable to opposite sides of said winch support beam in a manner permitting said brace arms to extend over said stabilizer bar to lateral mounting locations on said watercraft-supporting assembly.

25. A watercraft ramp comprising:

(i) a watercraft-supporting assembly having a pair of rails of substantial equal length braced in parallel laterally spaced-apart relationship by cross braces so that said rails are separated at least 8 inches apart from each other, said watercraft-supporting assembly having one end called a water end and the other end called a shore end, (ii) a shore end support assembly having a transverse footprint stabilizer bar mounted to the underside of said rails at a location proximate to said shore end in a manner such that said mounting is inward from the outer ends of said stabilizer bar, said transverse footprint stabilizer bar having a transverse length greater than the lateral spacing distance between said rails, and (iii) a loading assembly having a winch support beam mounted rigidly to said transverse footprint stabilizer bar so that said winch support beam is upwardly cantilevered out beyond the shore end of said rails in an angular relationship to the length of said rails, said angular relationship being closer to a parallel relationship to said rails than a perpendicular relationship to said rails.

26. The ramp of claim 25 wherein said loading assembly additionally includes a pair of brace arms for said winch support beam, said pair of brace arms being mounted in opposing relationship to said winch support beam and then fanning out therefrom as they extend over said stabilizer bar to lateral mounting locations on said watercraft-supporting assembly.

27. The ramp of claim 26 wherein said lateral mounting locations on said watercraft-supporting assembly for said brace arms of said winch support beam are on a cross brace of said watercraft-supporting assembly, and wherein said mounting of said winch support beam is such as to permit the bow end of a watercraft on said ramp to extend out beyond the shore end of said rails and over at least one-half the length of said winch support beam without any interference by said winch support beam.

28. The ramp of claim 26 wherein said lateral mounting locations on said watercraft-supporting assembly for said brace arms of said winch support beam are on the rails of said watercraft-supporting assembly, and wherein said mounting of said winch support beam is such as to permit the bow end of a watercraft on said ramp to extend out beyond the shore end of said rails and over at least one-half the length of said winch support beam without any interference by said winch support beam.

29. The ramp of claim 25 additionally including stub elevational means on said stabilizer bar at the location of the mounting of said stabilizer bar to the underside of each said rail.

30. The ramp of claim 25 additionally including a winch mount to the outer end of said winch support beam.

31. The ramp of clamp 25 wherein said angular relationship of said winch support beam to the length of said rails is no greater than 35 degrees.

* * * * *

UNITED STATES PATENT AND TRADEMARK OFFICE

CERTIFICATE OF CORRECTION

PATENT NO. : 6,637,975 B2
DATED : October 28, 2003
INVENTOR(S) : Robert D. Foxwell It is certified that error appears in the above-identified patent and that said Letters Patent is hereby corrected as shown below:

Column 18,
Line 53, “mount” should be -- mounted --.

Signed and Sealed this

Eighteenth Day of May, 2004

JON W. DUDAS
*Acting Director of the United States Patent and Trademark Office*